US012305501B2

(12) United States Patent
Alerigi et al.

(10) Patent No.: US 12,305,501 B2
(45) Date of Patent: May 20, 2025

(54) DISTRIBUTED FIBER SENSING IN A PACKER FOR PERMANENT CASING AND FORMATION DEFORMATION MONITORING

(71) Applicant: SAUDI ARABIAN OIL COMPANY, Dhahran (SA)

(72) Inventors: Damian San Roman Alerigi, Al Khobar (SA); Jose Oliverio Alvarez, Houston, TX (US); Adrian Cesar Cavazos Sepulveda, Nuevo Leon (MX); Sameeh Issa Batarseh, Dhahran Hills (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 263 days.

(21) Appl. No.: 18/051,435

(22) Filed: Oct. 31, 2022

(65) Prior Publication Data

US 2024/0141777 A1 May 2, 2024

(51) Int. Cl.
*E21B 47/085* (2012.01)
*E21B 47/007* (2012.01)
*E21B 47/135* (2012.01)

(52) U.S. Cl.
CPC ..... *E21B 47/085* (2020.05); *E21B 47/007* (2020.05); *E21B 47/135* (2020.05)

(58) Field of Classification Search
CPC .... E21B 47/085; E21B 47/007; E21B 47/135; E21B 47/09; E21B 47/098; E21B 47/006; E21B 47/08; E21B 33/1208
See application file for complete search history.

(56) References Cited

U.S. PATENT DOCUMENTS 4,328,704 A 5/1982 Arpasi et al.
5,215,145 A * 6/1993 Ross ..... E21B 33/1208 166/217

(Continued)

FOREIGN PATENT DOCUMENTS

CN 101397903 B 8/2012
CN 214366031 U 10/2021

OTHER PUBLICATIONS

Wang, Albert, et al., "Angle Sensitive Pixels in CMOS for Lensless 3D Imaging", IEEE Custom Integrated Circuits Conference (CICC), pp. 371-374, 2009 (4 pages).

(Continued)

*Primary Examiner* — Andrew Jordan
(74) *Attorney, Agent, or Firm* — Osha Bergman Watanabe & Burton LLP

(57) ABSTRACT

An apparatus, method, and system for monitoring wellbore deformation is disclosed. The apparatus includes an expandable annular cylindrical packer and a plurality of assemblies mounted on an exterior circumferential surface of the packer. The plurality of assemblies are configured to be pressed against a wellbore surface by the packer. Each of the assemblies includes at least one fiber-optic coil embedded in a sheet of deformable substrate, a tray-shaped receptacle formed from a low thermal conductivity material and attached along the rim to an edge of the sheet with a pressure tight-seal, and an optical coupler configured to couple the fiber-optic coil to a fiber-optic cable. The assemblies further include a pressure-tight compartment containing a high-pressure inert gas that is formed by the receptacle, the sheet, and the seal.

15 Claims, 12 Drawing Sheets

(56) References Cited

U.S. PATENT DOCUMENTS 5,517,854 A 5/1996 Plumb et al.
6,931,149 B2 8/2005 Hagene et al.
6,978,832 B2 * 12/2005 Gardner ..... E21B 47/00 166/305.1
7,000,696 B2 * 2/2006 Harkins ..... E21B 47/07 166/70
7,322,422 B2 * 1/2008 Patel ..... E21B 33/127 166/278
7,832,477 B2 11/2010 Cavender et al.
7,874,354 B2 * 1/2011 Freyer ..... E21B 33/1216 166/134
7,946,341 B2 * 5/2011 Hartog ..... E21B 47/135 340/854.6
7,950,456 B2 5/2011 Cavender et al.
8,061,423 B2 * 11/2011 Lohbeck ..... E21B 33/128 166/207
8,074,511 B2 * 12/2011 Huiszoon ..... E21B 47/085 702/6
8,135,541 B2 * 3/2012 Davis ..... E21B 47/022 166/255.2
8,141,626 B2 * 3/2012 Freyer ..... E21B 33/1216 166/134
8,225,867 B2 * 7/2012 Hartog ..... E21B 41/0064 340/854.6
8,347,958 B2 * 1/2013 Hartog ..... G01V 1/226 340/854.6
8,511,404 B2 * 8/2013 Rasheed ..... E21B 47/085 175/263
8,770,283 B2 * 7/2014 Hartog ..... E21B 43/26 340/854.6
8,973,434 B2 3/2015 Albrecht et al.
9,074,462 B2 * 7/2015 Pearce ..... E21B 47/107
9,075,155 B2 7/2015 Luscombe et al.
9,122,033 B2 * 9/2015 Jaaskelainen ..... F16L 1/028
9,557,239 B2 * 1/2017 Chen ..... E21B 47/135
9,574,434 B2 2/2017 Albrecht et al.
9,677,342 B2 * 6/2017 Rasheed ..... A01N 43/40
10,036,247 B2 7/2018 Moronkeji et al.
10,081,998 B2 * 9/2018 Tunget ..... E21B 27/00
10,173,381 B2 * 1/2019 Xia ..... B29C 48/154
10,215,015 B2 * 2/2019 Xia ..... G01H 9/004
10,215,016 B2 * 2/2019 Xia ..... G01H 9/004
10,240,428 B2 * 3/2019 Eldho ..... E21B 33/12
10,370,957 B2 * 8/2019 Jin ..... G01V 1/226
10,392,932 B2 * 8/2019 Wilson ..... E21B 49/00
10,877,192 B2 12/2020 Bovero et al.
10,901,110 B2 * 1/2021 Wilson ..... G01R 33/032
10,927,661 B2 * 2/2021 Jaaskelainen ..... E21B 47/14
11,125,070 B2 * 9/2021 Shen ..... G06F 30/20
11,131,185 B1 * 9/2021 Jaaskelainen ..... E21B 49/00
11,150,374 B2 * 10/2021 Capoglu ..... E21B 47/00
11,193,896 B2 12/2021 Stewart et al.
11,220,903 B2 * 1/2022 Alvarellos Iglesias ..... E21B 49/006
11,230,915 B2 * 1/2022 Dusterhoft ..... G01V 8/16
11,428,097 B2 * 8/2022 Stark ..... E21B 47/07
11,566,487 B2 * 1/2023 Boul ..... C09K 8/44
11,619,097 B2 4/2023 Batarseh et al.
11,634,983 B2 * 4/2023 Werkheiser ..... E21B 47/007 166/250.01
11,674,387 B2 * 6/2023 Dupont ..... E21B 33/1208 166/250.01
11,708,759 B2 * 7/2023 Jaaskelainen ..... E21B 49/00 166/250.1
11,795,812 B2 * 10/2023 Kroczka ..... E21B 47/003
11,933,131 B2 * 3/2024 Lee ..... E21B 34/08
11,952,889 B2 * 4/2024 Yang ..... E21B 47/135
12,129,756 B2 * 10/2024 Livescu ..... E21B 17/023
2003/0196820 A1 * 10/2003 Patel ..... E21B 33/127 166/387
2004/0040705 A1 * 3/2004 Harkins ..... E21B 33/072 166/250.07
2007/0068671 A1 * 3/2007 Lohbeck ..... E21B 33/128 166/227
2008/0291048 A1 * 11/2008 Huiszoon ..... E21B 47/085 73/152.01
2009/0159265 A1 * 6/2009 Freyer ..... E21B 33/1216 166/206
2009/0166040 A1 7/2009 Cavender et al.
2009/0271115 A1 * 10/2009 Davis ..... E21B 47/022 702/6
2011/0066380 A1 3/2011 Hager et al.
2011/0088892 A1 * 4/2011 Freyer ..... E21B 33/1216 166/134
2011/0188344 A1 * 8/2011 Hartog ..... G01V 1/226 367/27
2012/0037422 A1 * 2/2012 Rasheed ..... E21B 47/09 175/344
2012/0143523 A1 * 6/2012 Chen ..... G01L 1/246 702/42
2012/0143524 A1 * 6/2012 Chen ..... E21B 47/007 702/42
2012/0277995 A1 * 11/2012 Hartog ..... E21B 47/06 702/8
2012/0312560 A1 12/2012 Bahr et al.
2013/0034324 A1 2/2013 Laing et al.
2013/0092371 A1 * 4/2013 Hartog ..... E21B 47/06 166/250.01
2013/0306375 A1 * 11/2013 Rasheed ..... E21B 44/00 175/45
2014/0060933 A1 * 3/2014 Rasheed ..... E21B 47/12 175/50
2014/0105533 A1 * 4/2014 Jaaskelainen ..... F16L 1/028 385/12
2014/0158430 A1 * 6/2014 Rasheed ..... E21B 47/085 175/45
2014/0299385 A1 * 10/2014 Rasheed ..... E21B 47/09 175/394
2014/0311802 A1 * 10/2014 Rasheed ..... E21B 7/28 175/45
2014/0360613 A1 12/2014 Abshire et al.
2015/0152704 A1 * 6/2015 Tunget ..... E21B 17/05 166/299
2016/0258245 A1 * 9/2016 Eldho ..... E21B 33/129
2017/0138187 A1 5/2017 Moronkeji et al.
2017/0204726 A1 * 7/2017 Lecampion ..... H04L 27/223
2017/0259513 A1 * 9/2017 Xia ..... B29C 71/0063
2017/0260847 A1 * 9/2017 Xia ..... G01H 9/004
2017/0260848 A1 * 9/2017 Xia ..... E21B 47/135
2017/0336525 A1 * 11/2017 Wilson ..... G01V 3/28
2018/0119535 A1 * 5/2018 Shen ..... E21B 45/00
2018/0252093 A1 * 9/2018 Cramm ..... G01V 9/005
2018/0291726 A1 * 10/2018 Jaaskelainen ..... G01V 1/52
2019/0064387 A1 2/2019 Ohanian, III et al.
2019/0169985 A1 * 6/2019 Dickenson ..... G01K 11/32
2020/0081148 A1 * 3/2020 Capoglu ..... E21B 47/00
2021/0032985 A1 * 2/2021 Stark ..... E21B 47/07
2021/0040841 A1 * 2/2021 Dusterhoft ..... G01V 1/226
2021/0222540 A1 * 7/2021 Kroczka ..... G01M 5/0033
2021/0238953 A1 * 8/2021 Boul ..... C04B 28/02
2021/0238979 A1 * 8/2021 Stokely ..... E21B 33/14
2021/0239549 A1 * 8/2021 Maida ..... G01L 1/242
2021/0262343 A1 8/2021 Dupont et al.
2021/0301653 A1 * 9/2021 Jaaskelainen ..... E21B 17/206
2021/0372277 A1 * 12/2021 Werkheiser ..... G01L 1/2287
2021/0388712 A1 * 12/2021 Liang ..... E21B 49/006
2021/0388718 A1 * 12/2021 Jin ..... E21B 43/11
2022/0049601 A1 * 2/2022 Jaaskelainen ..... G01V 1/42
2022/0170340 A1 * 6/2022 Lee ..... E21B 29/10
2022/0243587 A1 * 8/2022 Yang ..... E21B 43/12
2022/0316331 A1 10/2022 Cavazos Sepulveda et al.
2022/0372868 A1 11/2022 Alerigi et al.
2022/0403736 A1 * 12/2022 Livescu ..... E21B 47/135
2023/0041700 A1 * 2/2023 Blois ..... G01S 7/4813
2023/0057678 A1 * 2/2023 Lee ..... E21B 29/10
2023/0332471 A1 * 10/2023 McGuigan ..... E21B 34/06
2023/0332497 A1 * 10/2023 McGuigan ..... E21B 47/01
2024/0061124 A1 * 2/2024 Blois ..... G01S 7/487
2024/0141777 A1 * 5/2024 Alerigi ..... E21B 47/098

(56) References Cited

U.S. PATENT DOCUMENTS

| | | | | |
|---|---|---|---|---|
| 2024/0193315 | A1* | 6/2024 | Ramakrishnan | G06F 30/13 |
| 2024/0360737 | A1* | 10/2024 | Least | E21B 33/1208 |
| 2024/0376787 | A1* | 11/2024 | Isted | E21B 41/00 |

OTHER PUBLICATIONS

Hadi, Fatemeh, et al., "Assessment of Performance of Tesla Turbine in Water Distribution Systems for Energy Harvesting", Journal of Energy Resources Technology, vol. 143, 2021 (8 pages).
Mao, Huina, et al., "Twist, tile and stretch: From isometric Kelvin cells to anisotropic cellular materials", Materials and Design 193, pp. 1-15, 2020 (15 pages).
Ming, Zunzhen, et al., "Switching between Elasticity and Plasticity by Network Strength Competition", Advanced Materials, 2020 (8 pages).
Tohidi, Shafagh D., et al., "Microstructural-mechanical properties relationship in single polymer laminate composites based on polyamide 6", Composites Part B 153, pp. 315-324, 2018 (10 pages).
Zheng, Guoan, "Angle-sensitive pixel design for wavefront sensing", 2013 (4 pages).
Rambow, F.H.K. et al., "Real-Time Fiber-Optic Casing Imager", SPE Journal, Dec. 2010, pp. 1095-1103 (9 pages).
Kadambi, Achuta et al, "Rethinking Machine Vision Time of Flight With GHz Heterodyning"; IEEE Access, Massachusetts Institute of Technology, Cambriudge, MA, vol. 5, 2017 (13 pages).
Köchert Paul et al, "A fully-fibre coupled interferometer system for displacement and angle metrology"; euspen's 16th International Conference & Exhibition, Nottingham, UK, May 2015 (2 pages).
Krishnan Vedavalli G. et al, "A Micro Tesla Turbine for Power Generation from Lower Pressure Heads and Evaporation Driven Flows"; University of California Berkeley, CA, US, 2011 (5 pages).
Office Action issued in related U.S. Appl. No. 17/643,487, dated Apr. 28, 2023 (8 pages).
International Search Report and Written Opinion issued in Application No. PCT/US2023/078209, mailed on Feb. 21, 2024 (15 pages).

* cited by examiner

DISTRIBUTED FIBER SENSING IN A PACKER FOR PERMANENT CASING AND FORMATION DEFORMATION MONITORING

BACKGROUND

Metal loss and deformation compromise the structural integrity of downhole completions. These issues may arise as the result of the degradation of the material due to natural and human-made processes, e.g., variations in the stress/strain caused by tectonic movements, corrosion and erosion due to production, damage by explosive-based perforations and similar stimulation techniques. Typical characterization methods for casing deformation include time lapse caliper logs, flux leakage logs, electromagnetic shift tools, and ultrasonic tools.

The main challenges with monitoring casing deformation include inaccuracy/blind spots (a caliper's fingers may miss an area with high metal loss), lack of real-time visualization, data processing, analysis, and uncertainty on the location of electromagnetic sensors. Hence, it is vital to provide measurement systems that monitor deformations in real-time.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a wellbore deformation instrument. The wellbore deformation instrument includes an expandable annular cylindrical packer; a plurality of assemblies mounted on an exterior circumferential surface of the packer and configured to be pressed against a wellbore surface by the packer, wherein the each of the assemblies includes: at least one fiber-optic coil embedded in a sheet of deformable substrate, a tray-shaped receptacle formed from a low thermal conductivity material and attached along a rim of the receptacle to an edge of the sheet with a pressure tight-seal, wherein a pressure-tight compartment formed by the receptacle, the sheet, and the seal contains a high-pressure inert gas, and an optical coupler, configured to couple the at least one fiber-optic coil to a fiber-optic cable.

In one aspect, embodiments relate to a system. The system includes a wellbore deformation instrument, including: an expandable annular cylindrical packer, a plurality of assemblies mounted on an exterior circumferential surface of the packer and configured to be pressed against a wellbore surface by the packer, wherein the each of the assemblies comprises: at least one fiber-optic coil embedded in a sheet of deformable substrate, a tray-shaped receptacle formed from a low thermal conductivity material and attached along a rim of the receptacle to an edge of the sheet with a pressure tight-seal, wherein a pressure-tight compartment formed by the receptacle, the sheet, and the seal contains a high-pressure inert gas, and an optical coupler, configured to couple the at least one fiber-optic coil to a fiber-optic cable; a fiber-optic cable deployed in a wellbore running from a wellhead into a subsurface formation and optically coupled, through the optical coupler, to each of the at least one fiber-optic coil; and an optical analyzer, configured to launch a laser pulse into the fiber-optic cable at the wellhead and receive a backscattered laser pulse from each of the at least one fiber-optic coil through the fiber-optic cable.

In one aspect, embodiments relate to a method for monitoring wellbore deformation, including: inserting a wellbore deformation instrument, attached to a fiber-optic cable into a wellbore to a predetermined depth; expanding the wellbore deformation instrument, wherein expanding the wellbore deformation instrument presses a plurality of deformation sensors against a wellbore surface; launching a plurality of laser pulses, at a plurality of monitoring times separated from one another by an interval of time, from an optical analyzer located at a wellhead into the fiber-optic cable; detecting, from each of the plurality of laser pulses, a backscattered laser pulse; and determining a deformation of the wellbore surface based, at least in part, on a difference between the backscattered laser pulse for one or more pairs of monitoring times.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1A:
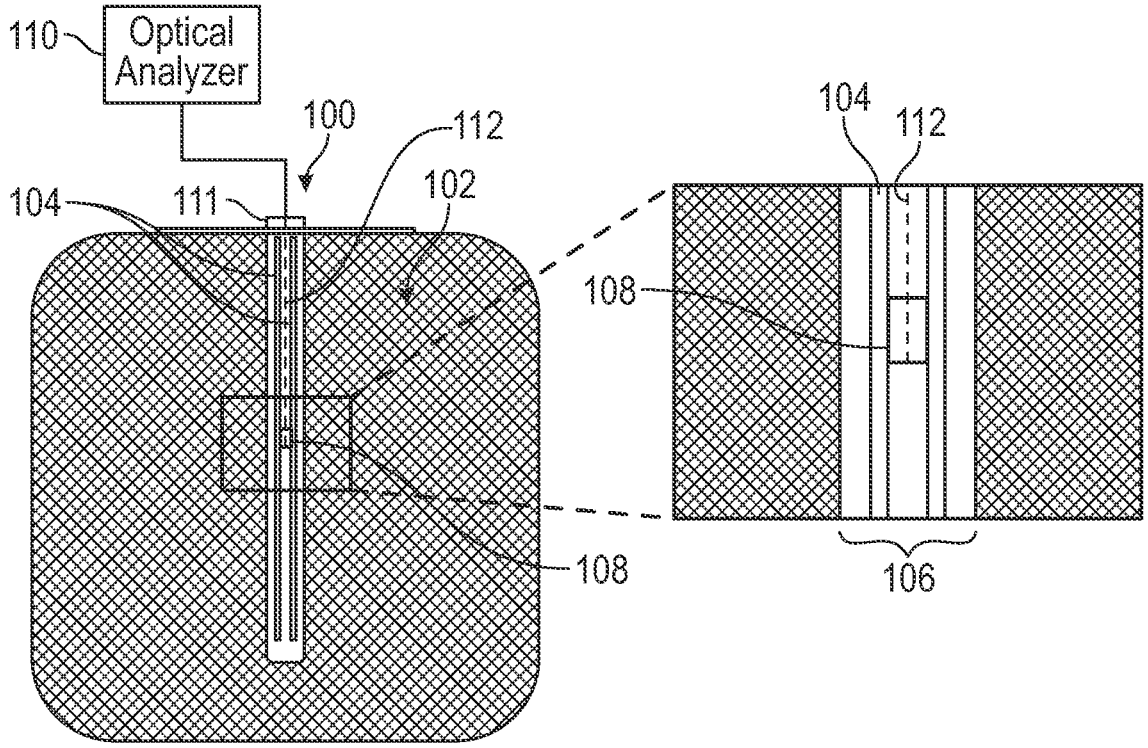
FIG. 1A shows a well in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-12, any component described regarding a figure, in various embodiments disclosed herein, may be equivalent to one or more like-named components described with regard to any other figure. For brevity, descriptions of these components will not be repeated regarding each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

It is to be understood that the singular forms "a," "an," and "the" include plural referents unless the context clearly dictates otherwise. Thus, for example, reference to "an autonomous sensor" includes reference to one or more of such autonomous sensors.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that one or more of the steps shown in the flowcharts may be omitted, repeated, and/or performed in a different order than the order shown. Accordingly, the scope disclosed herein should not be considered limited to the specific arrangement of steps shown in the flowcharts.

Embodiments disclosed herein relate to a system and a method for permanently monitoring casing and formation deformations using strain and shape sensing optical fiber sensors. This design provides several benefits:

a. Permanent monitoring of deformation of pipes, tubulars, metallic and non-metallic completions, cement strings/casing, and open-hole sections;
b. Monitoring deformation simultaneously at various azimuthal positions within a given height;
c. Multi-point characterization with varying degrees of resolution (i.e., the resolution can be increased along the azimuthal and height axes, if necessary); and
d. Monitoring in conjunction with downhole tests and stimulation, thus supporting measurements of formation deformation during coring, stress analysis, and stimulation.

FIG. 1A illustrates a system in accordance with one or more embodiments. Specifically, FIG. 1A shows a well (100) that may be drilled in the subsurface formation (102). Casing (104) is pipe that may be lowered into a borehole (106) and is designed to resist compressive and tensile stresses in the subsurface formation (102). The borehole (106) corresponds to the uncased portion of the well (100). The well (100) includes a packer (108). The packer (108) is a device that plugs or blocks a portion of the borehole (106) during drilling or production operations. The packer (108) has a smaller inside initial diameter along with a means of expanding radially, and thereby coupling with the casing (104) or borehole (106). The packer (108) may be lowered into a well with wireline, pipe, or coiled tubing. Some packers (108) are placed temporarily into a well; others are installed permanently. When used during hydrocarbon production, packers (108) are typically used to seal off a section of the well (100), thereby allowing for controlled extraction from the well (100).

Figure 1B:
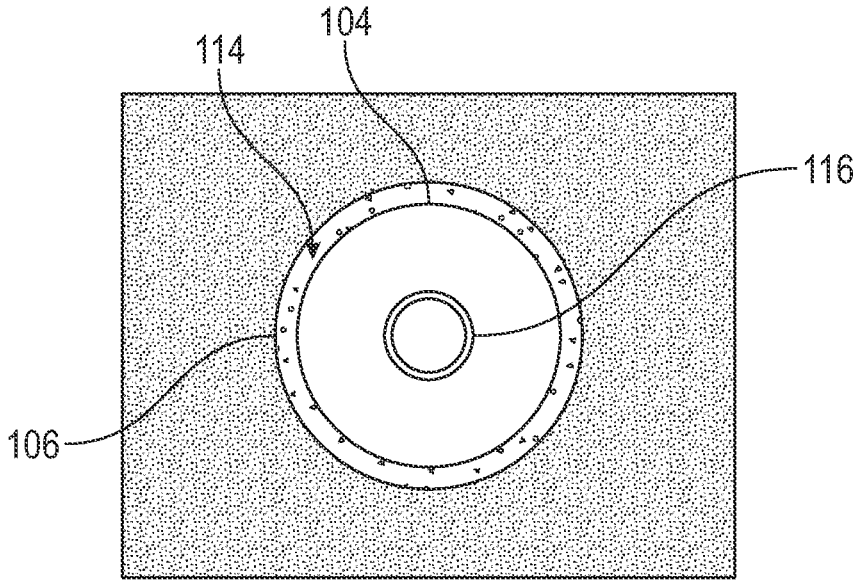
FIG. 1B shows a cross section of a well in accordance with one or more embodiments.

FIG. 1B shows a cross-section of a well (100). Casing (104) is shown installed within the borehole (106), and cement (114) may fill the space between the casing (104) and the borehole (106). Production tubing (116) lies in the annulus within the casing (104).

In accordance with FIGS. 1A and 1B, data transmission cables may be used to connect sensors in the borehole (106) with an optical analyzer (110) at the wellhead (111). The wellhead (111) is at the Earth's surface. In particular, fiber-optic cables (112) are a new technology that can transmit measurements obtained by sensors to the optical analyzer (110) by modulating a signal onto a carrier wave of light, such as a laser pulse. The fiber-optic cable (112) may be deployed in the wellbore running from the wellhead (111) into the subsurface formation (102). Another way to obtain information with a fiber-optic cable (112) is to use the cable itself as a sensor. In one or more embodiments, the use of fiber-optic cables (112) to detect strain and deformation in casing (104) or in a borehole (106) is shown.

Figure 2:
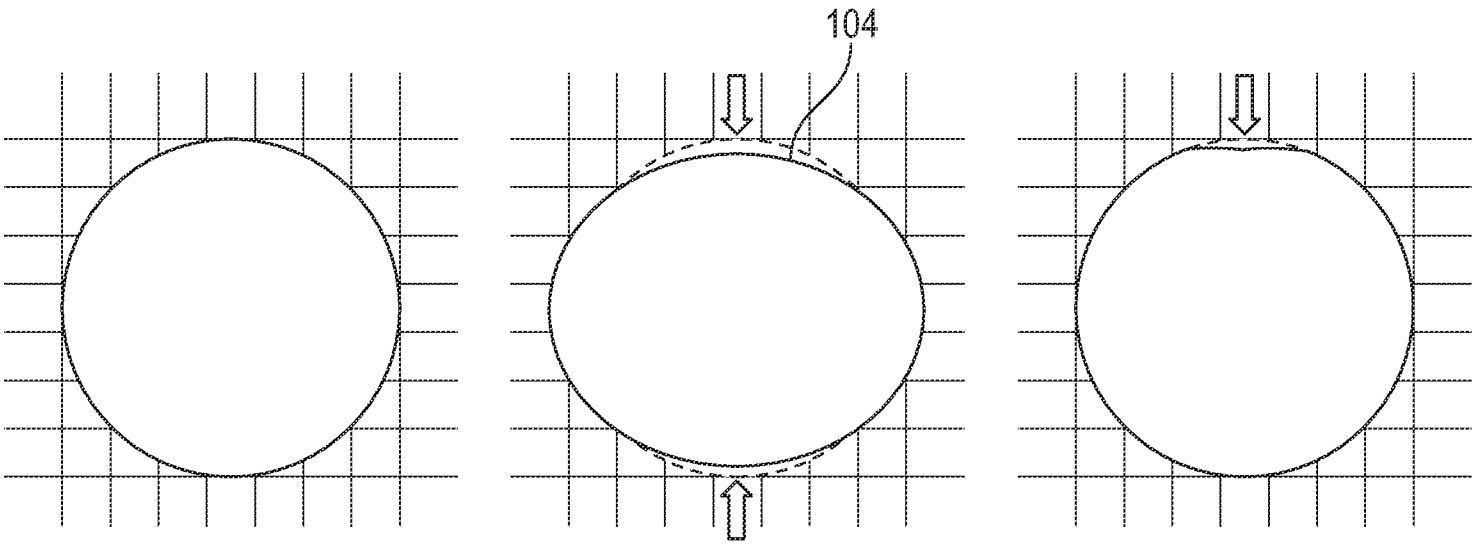
FIG. 2 shows an example of strain and deformation on casing in accordance with one or more embodiments.

FIG. 2 shows an example of strain and deformation on the casing (104) in accordance with one or more embodiments. Strain and deformation are common in the industry and may be caused by natural and human-made processes. The arrows illustrated in FIG. 2 express examples of direction that the casing (104) may deform or strain. The deformation and strain are illustrated by the difference of the dashed line and the solid circle.

Figure 3:
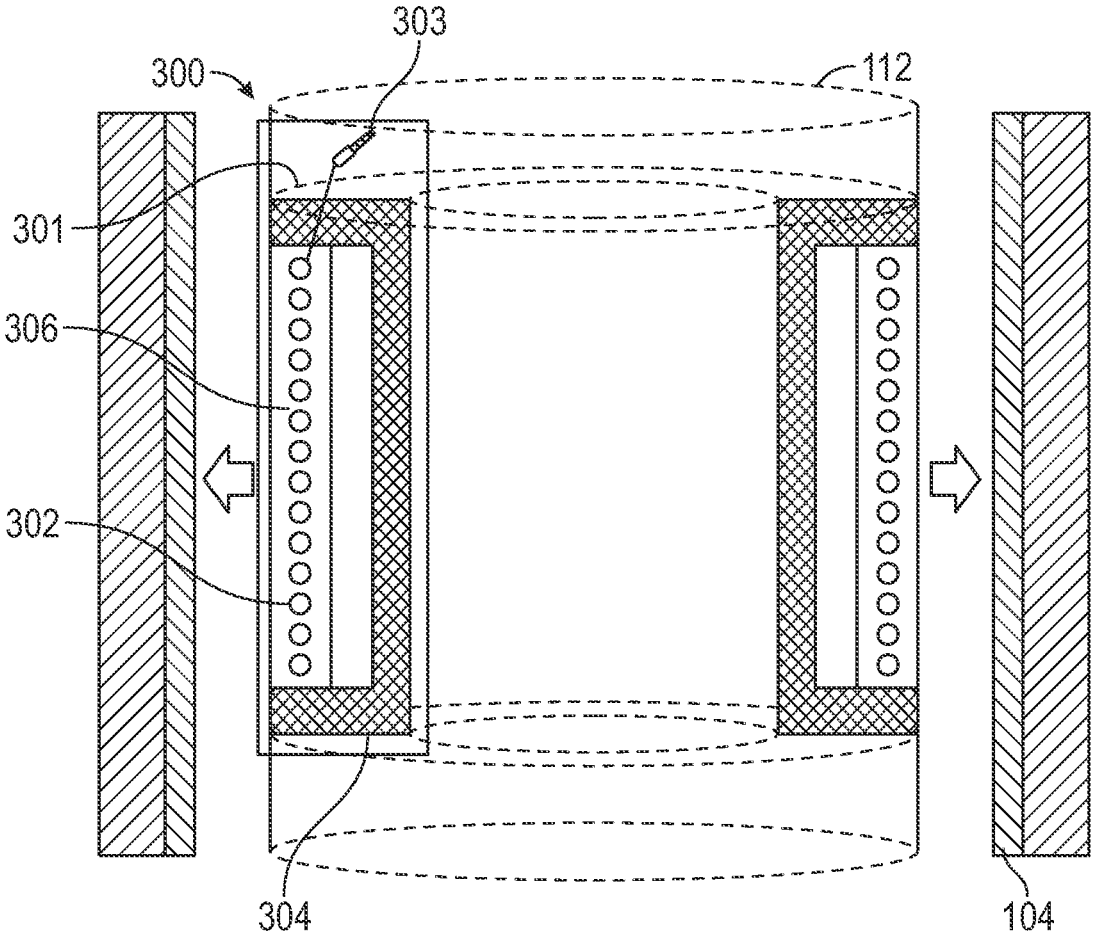
FIG. 3 shows a wellbore deformation instrument in accordance with one or more embodiments.

FIG. 3 shows a wellbore deformation instrument (300) in accordance with one or more embodiments. The wellbore deformation instrument (300) may employ, as part of the tool, the packer (108) in FIG. 1A. The wellbore deformation instrument (300) may be used to measure the strain and deformation similar to FIG. 2. In one or more embodiments, the wellbore deformation instrument (300) is a tool where an elastic substrate is in contact with, and deforms following the shape of, the metallic tubular. Optical fibers mounted on the substrate capture its deformed shape and strain locally (e.g., across a grid defined on the substrate covering an area of ~1-100 $mm^2$) The shape is derived from the optical frequency-domain or time-domain reflectance (OFDR or OTDR) of a fiber sensor comprising at least three fibers (or a multi-core fiber) arranged in a helical pattern.

In one or more embodiments, the wellbore deformation instrument (300) includes the packer (108) and a plurality of assemblies (301) mounted on the exterior circumferential surface of the packer (108). In one or more embodiments, the packer (108) is an expandable annular cylindrical packer. The packer (108) is used as structural support and ensures contact with the metallic completion, production tubing, or the borehole. Ideally, the packer (108) should be thin enough to avoid restricting the flow. As shown by the arrows pointing in the direction outwards, the packer (108) may expand and push against the casing (104) wall. The packer may also expand and push against the borehole (106) wall in the absence of a casing (104). The plurality of assemblies (301) includes at least one fiber-optic coil (302) embedded in a sheet of deformable substrate (306), a tray-shaped receptacle (304), and an optical coupler (303).

The well deformation instrument (300) may be used to isolate sensors, such as the fiber-optic coil (302) from the borehole (106) environment, thus avoiding temperature or pressure effects that might be caused by it. The fiber-optic coil (302) is optically coupled to the fiber-optic cable (112) via the optical coupler (303). The optical coupler (303) may be any component configured to couple the fiber-optic coil (302) to the fiber-optic cable (112). The fiber-optic coil (302) may be optical fibers used as sensors. To use a fiber-optic coil (302) as a sensor, the optical analyzer (110) sends laser pulses that travel through the fiber-optic cable (112) and fiber-optic coil (302), emitting backscattered laser pulses that are reflected back to the optical analyzer (110) from the end of the fiber-optic cable (112). Changes in the properties of the backscattered laser pulse are indicative of physical changes occurring in the fiber-optic coil (302).

Rayleigh backscattering is one type of scattering that occurs when scattering locations distributed throughout the fiber-optic coil (302) reflect the input laser pulses back to the optical analyzer (110). The optical analyzer (110) measures changes in the phase, wavelength, and intensity of the backscattered laser pulses. Changes in wavelength may be used to measure relative changes in temperature in the fiber-optic coil (302). Changes in intensity may be used to detect changes in pressure. Changes in the phase of backscattered laser pulses may be indicative of strain in the fiber-optic coil (302).

Other scattering effects may be used to obtain data from a fiber-optic coil (302). Brillouin scattering occurs when acoustic phonons traveling within the fiber-optic coil (302) interact with the input laser pulse. The backscattered laser pulses from Brillouin scattering are much weaker than those from Rayleigh backscattering and require summing multiple backscattered laser pulses related to the same event to obtain an accurate measurement. This limits applicability of the method to frequencies up to a few tens of Hertz. However, Brillouin scattering allows for measurements of the absolute value of temperature—something that Rayleigh scattering cannot do. Raman backscattering occurs when light is scattered at the molecular spatial scale. Raman backscattered laser pulses are weaker than those from Brillouin scattering and require summing signals over many seconds. This limits the applicability of this technique solely to measuring the absolute value of temperature.

In one or more embodiments, the fiber-optic coil (302) may be utilized as a multi-pixel time-of-flight sensing method to characterize deformation. The multi-pixel may refer to each measurement region of one or more fiber-optic coils (302). The multi-pixel time-of-flight sensing method may be multi-point characterization with varying degrees of resolution. For example, the number of pixels or measurements may be increased as necessary to provide a finer resolution along the azimuthal and altitude axes.

The optical analyzer (110) makes use of optical reflectometry to detect physical changes in the fiber-optic coil (302). The optical analyzer (110) may be an optical time domain reflectometer (OTDR) or an optical frequency domain reflectometer (OFDR). The processing of laser pulses may be done in the time domain with the OTDR or in the frequency domain with the OFDR. Processing with an OFDR offers better resolution than an OTDR, but the OTDR allows for longer cable lengths.

The fiber-optic coil (302) may be of a conventional type, which has intrinsic backscattering, or it may be engineered in a specific way, for example, with a fiber Bragg grating (FBG), that is capable of selectively reflecting and transmitting certain wavelengths of light. FBGs are used in one of the embodiments of the fiber-optic coil (302) described in this document and enable an increased signal to noise ratios which may lead to increased processing speed.

The fiber-optic coil (302) may be any of the following configurations:

a. A single mode fiber in combination with an optical time domain reflectometry (OTDR) analyzer;
b. Multiple non-overlapping fibers up to 20 m long in combination with an optical frequency domain reflectometry (OFDR) analyzer; and
c. Multiple non-overlapping fibers with three or more fiber Bragg gratings (FBGs).

The fiber-optic coils (302) may be fiber-sensing of strain and deformation that can either be discrete or distributed. Discrete fiber sensing utilizes a FBGs or a Fabry-Perot (F-P) cavity. Distributed sensors of the fiber-optic coils (302) are based on analysis of Rayleigh, Brillouin, or Raman scattering via optical time domain reflectometry (OTDR) or optical frequency domain reflectometry (OFDR).

The tray-shaped receptacle (304) is formed from a low thermal conductivity material such as fiberglass composite. The low thermal conductivity material is attached along the rim of the tray-shaped receptacle (304) to the edge of the deformable substrate (306) with a pressure tight-seal. The tray-shaped receptacle (304), the deformable substrate (306), and the pressure tight-seal may form a pressure-tight compartment containing a high-pressure inert gas.

The deformable substrate (306) may be on the outer side of the wellbore deformation instrument (300). The deformable substrate (306) may deform to follow the shape of the material it is in contact with, i.e., the casing (104) or borehole (106). The deformable substrate (306) may be constructed, without limitation, from high-temperature elastomers, flexible thermoplastics, or shape memory polymers (SMPs) with low thermal expansion (<0.01 mm/K) and low thermal conductivity (0.03-0.1 W/mK). SMPs return to their original shape using an electrical signal, thus enabling quick release and retrieval of the wellbore deformation instrument (300) and in situ recalibration.

The deformable substrate (306) can be unconstrained or constrained along the radial direction. The latter can be achieved by using anisotropic materials such as composites or plastics with aligned chains in an elastomeric matrix, embedded with woven reinforcements, as well as anisotropic hydrogels materials with cellular micro/nanostructures or combinations thereof. The composite may be fiberglass.

Figure 4:
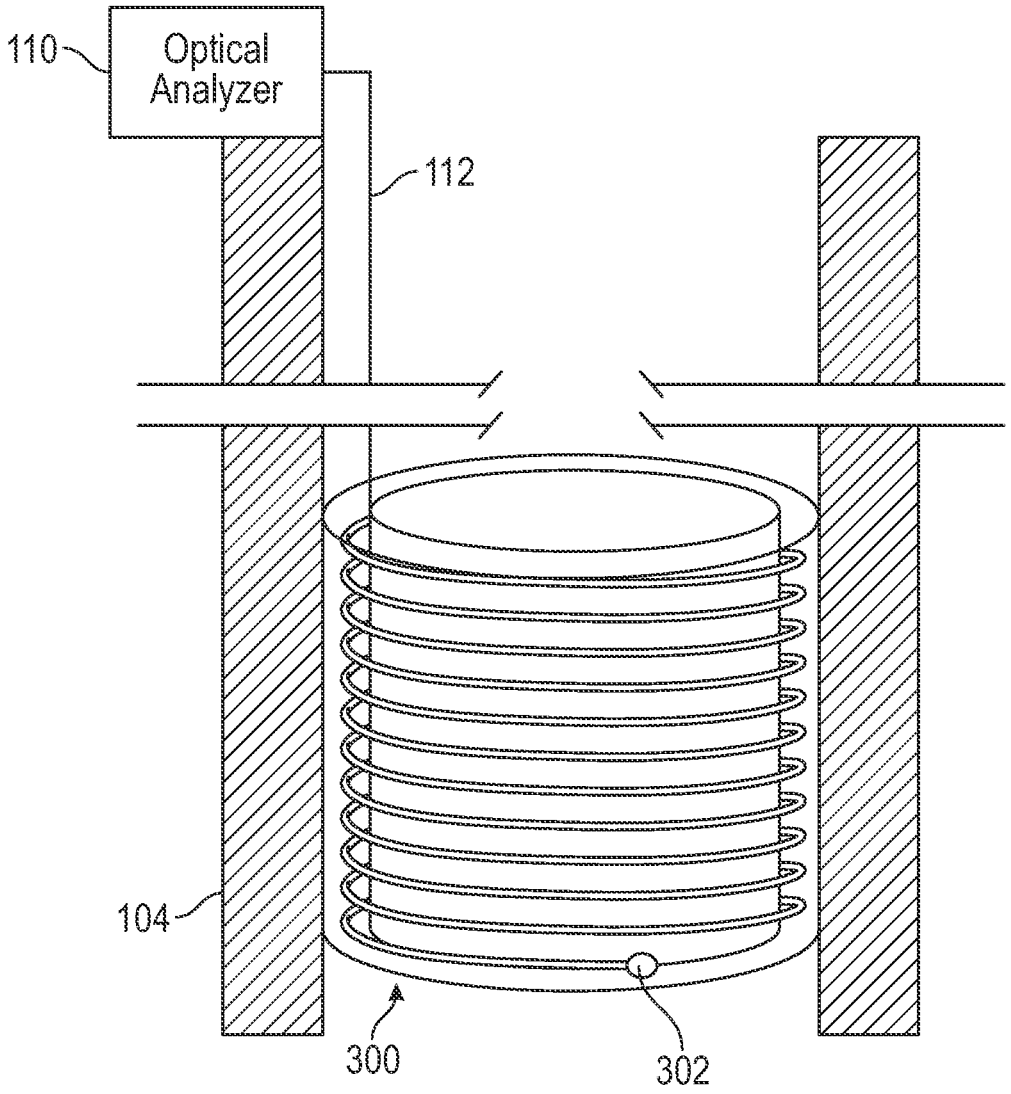
FIG. 4 shows the wellbore deformation instrument fitted with optical fiber in a helical pattern.

FIG. 4-8 show various embodiments of fiber-optic coil (302) mounted onto the deformation substrate (306) in the wellbore deformation instrument (300) within the casing (104). In one or more embodiments, FIG. 4 shows a configuration of a wellbore deformation instrument (300) with a fiber-optic coil (302) wound in a helical pattern. In this case, the distance between fibers should be at least 10 mm. The fiber-optic coil (302) may then travel to the optical analyzer (110).

Figure 5:
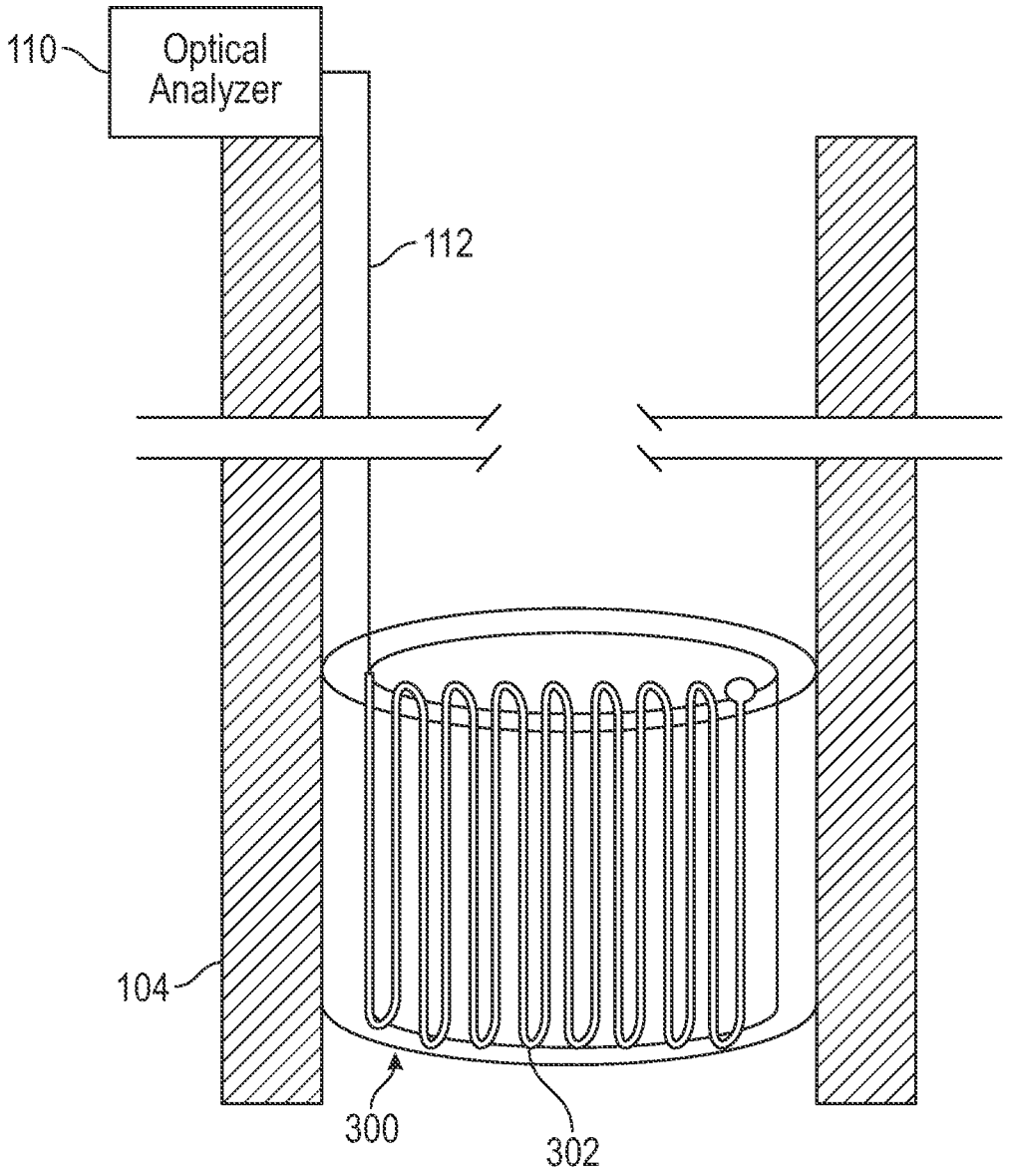
FIG. 5 shows the wellbore deformation instrument fitted with optical fiber in a serpentine pattern.

FIG. 5 shows a configuration of the wellbore deformation instrument (300) with fiber-optic coil (302) wound in an axial serpentine pattern. In this case, the distance between fibers should be 10 mm or larger to ensure the bending radius is above 10 mm. The fiber-optic coil (302) may connect to the fiber-optic cable (112). The fiber-optic cable (112) may connect to the optical analyzer (110), such as an OFDR.

Figure 6:
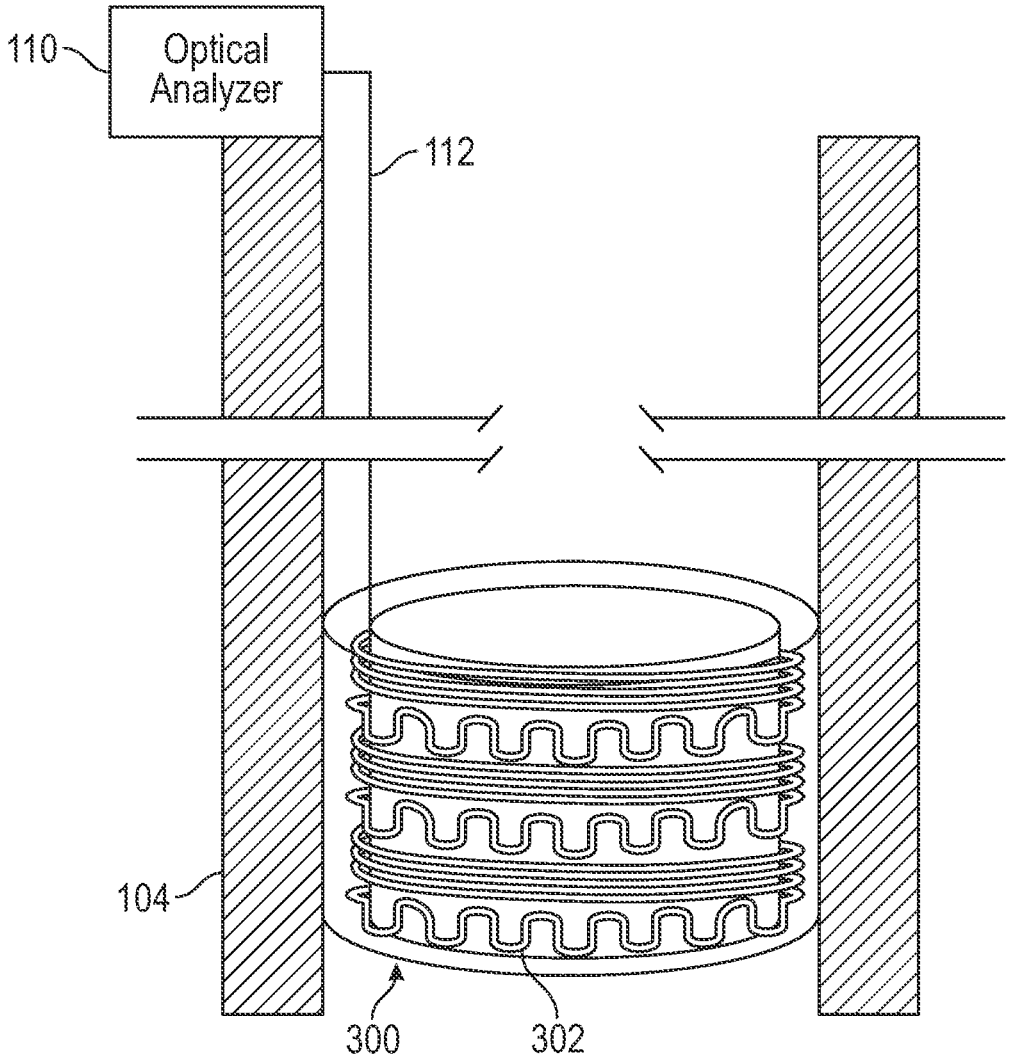
FIG. 6 shows the wellbore deformation instrument fitted with optical fiber in a mixed helical-serpentine pattern.

FIG. 6 shows a configuration of the wellbore deformation instrument (300) combining an axial serpentine and a helical pattern of the fiber-optic coil (302). In this case, the distance between fibers of the fiber-optic coil (302) should be 10 mm or larger to ensure the bending radius is above 10 mm. The fiber-optic coil (302) may connect to the fiber-optic cable (112). The fiber-optic cable (112) may connect to the optical analyzer (110), such as an OFDR.

Figure 7:
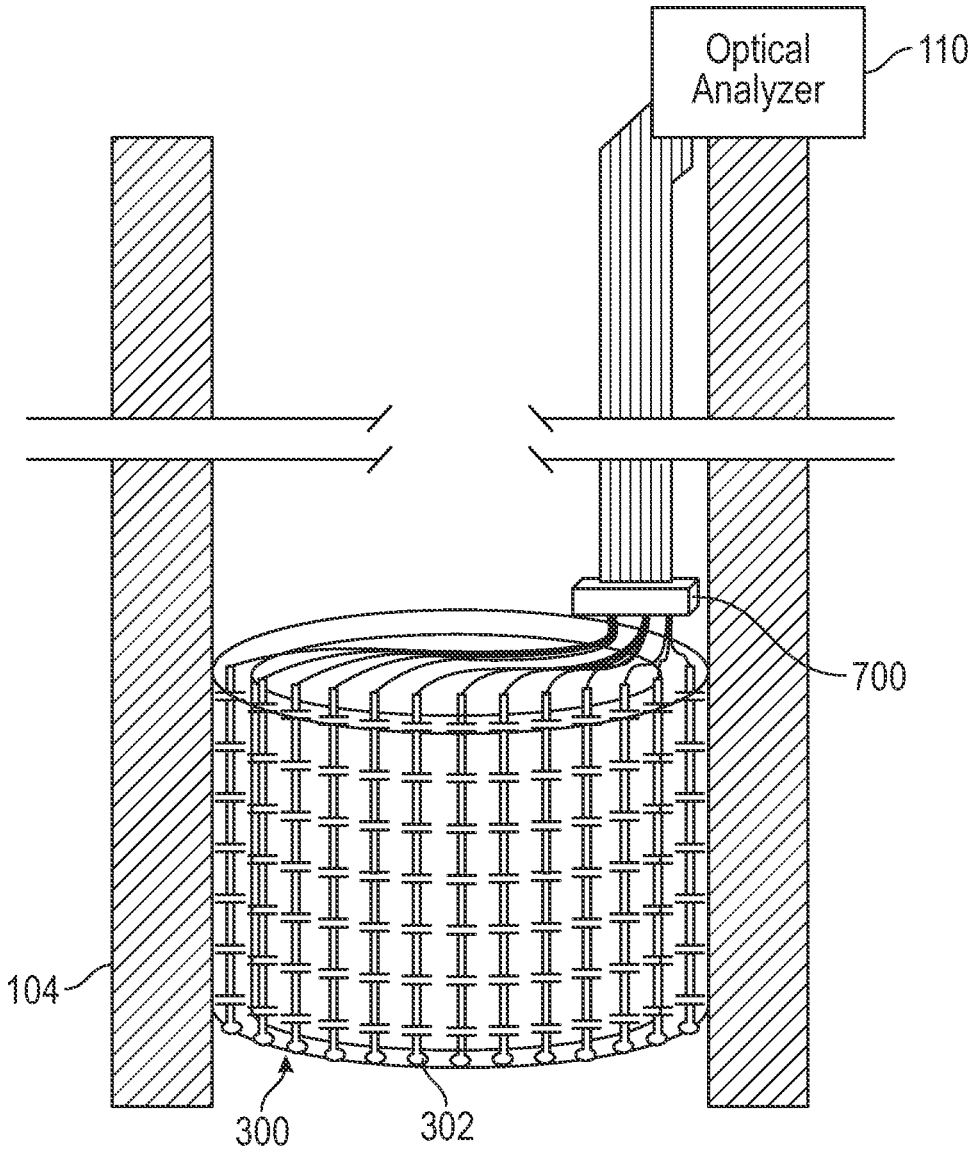
FIG. 7 shows the wellbore deformation instrument fitted with optical fiber with Bragg grating.

FIG. 7 shows a configuration of the wellbore deformation instrument (300) using multiple distributed FBG sensors in the fiber-optic coil (302) distributed horizontally. The number of FBG sensors inscribed in each fiber should be three or more. The maximum number is determined by the length of the fiber and the minimum separation. The FBG sensors are connected to an N×M coupler (700) that may be used to split combine laser pulses with minimal optical loss from one fiber to multiple fibers. Each FBG is tuned to reflect a specific wavelength of light. The fiber termination can be a perfect mirror, or the transmitted laser pulse can be returned to a separate analyzer or the optical analyzer (110).

Figure 8:
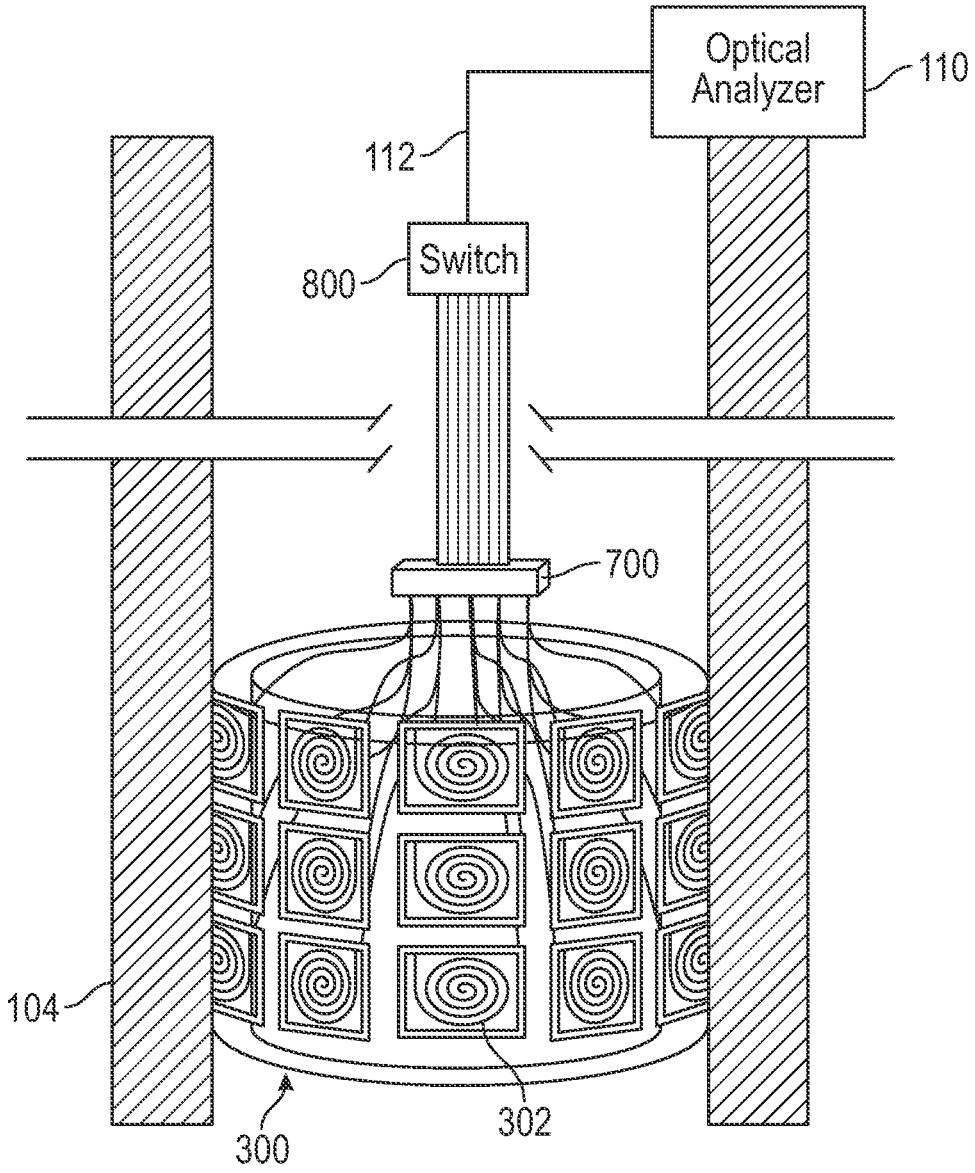
FIG. 8 shows a multichannel optical fiber with mixed helical-serpentine pattern.

FIG. 8 shows a configuration of the fiber-optic coil (302) in the wellbore deformation instrument (300) combining an axial serpentine and helical distribution mounted on an anisotropic displacement material. The rectangle shown in FIG. 8 around the fiber-optic coil (302) may a pixel or measurement region. The distance between fibers for this configuration should be 10 mm or larger to ensure the bending radius is above 10 mm. The fibers may be connected to the N×M coupler (700) that may be used to split combined laser pulses with minimal optical loss from one fiber to multiple fibers. The split fibers may be connected to a switch (800) such as an optical switch that converts the laser pulses to electrical data before forwarding it to the optical analyzer (110) through the fiber-optic cable (112). The switch (800) may use a 1×2 90/10 laser pulse splitter, with the end of the 10%-transmission-arm ending in a mirror, or a partially reflective window (90/10) to return a portion (<10%) of the input laser pulse (signal) for compensation. The wellbore deformation instrument (300) may use a separate laser per each fiber-optic coil (302). For example, each fiber-optic coil (302) may be connected to its own laser. Alternatively, the well deformation instrument (300) may use a single laser unit source and the switch (800) to direct laser pulses to each fiber-optic coil (302). In another embodiment, the well deformation instrument (300) may use the switch (800) at each of the N-sources of lasers to direct laser pulses to each of the fiber-optic coils (302) connected to their N-source laser. The possible patterns in which the fiber-optic cable (112) is shaped is not limited by the examples shown in FIG. 4-8.

Figure 9:
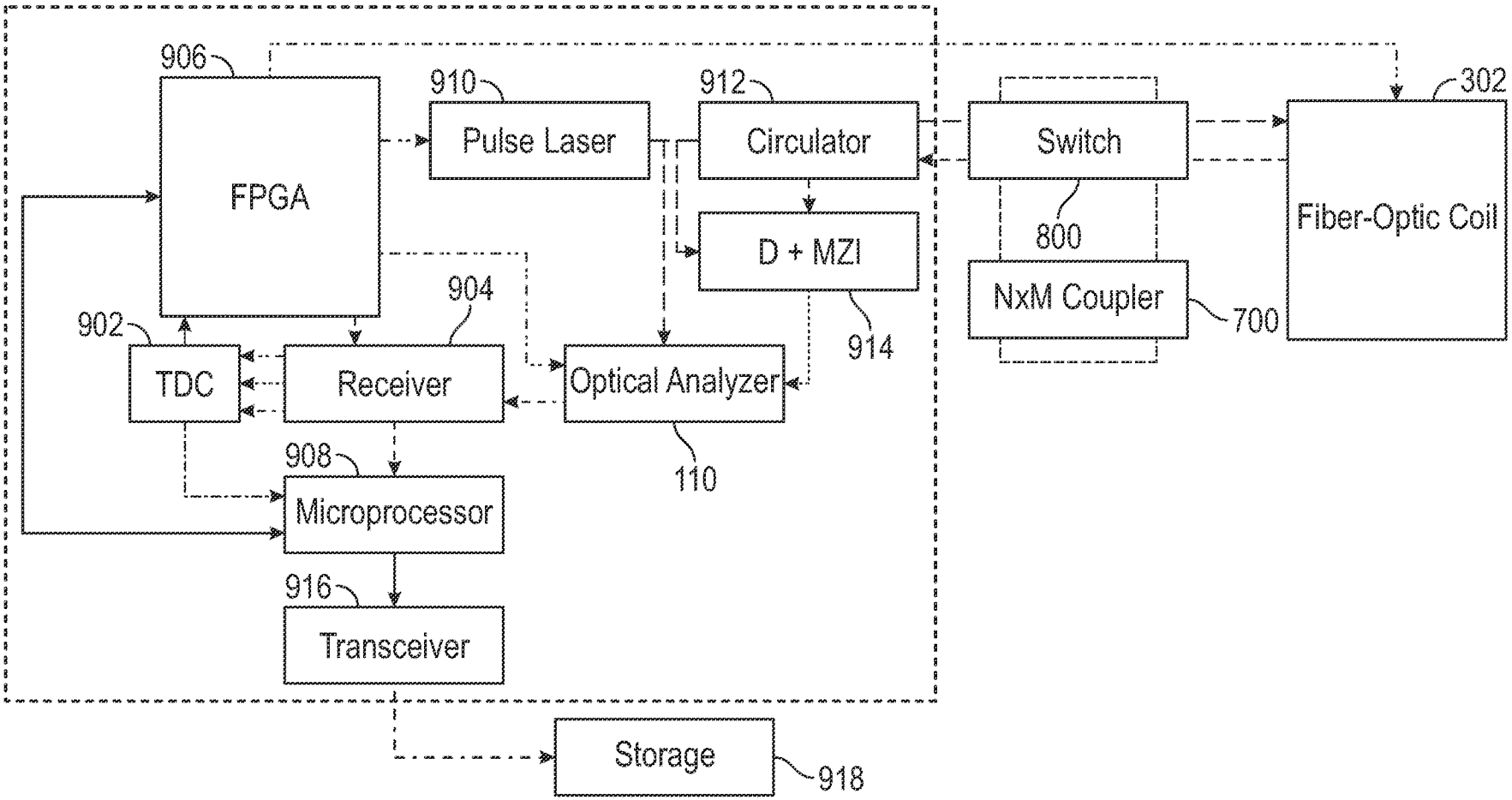
FIG. 9 shows a schematic of electronics and signal processing for N-source and M-fiber probes.
Figure 10:
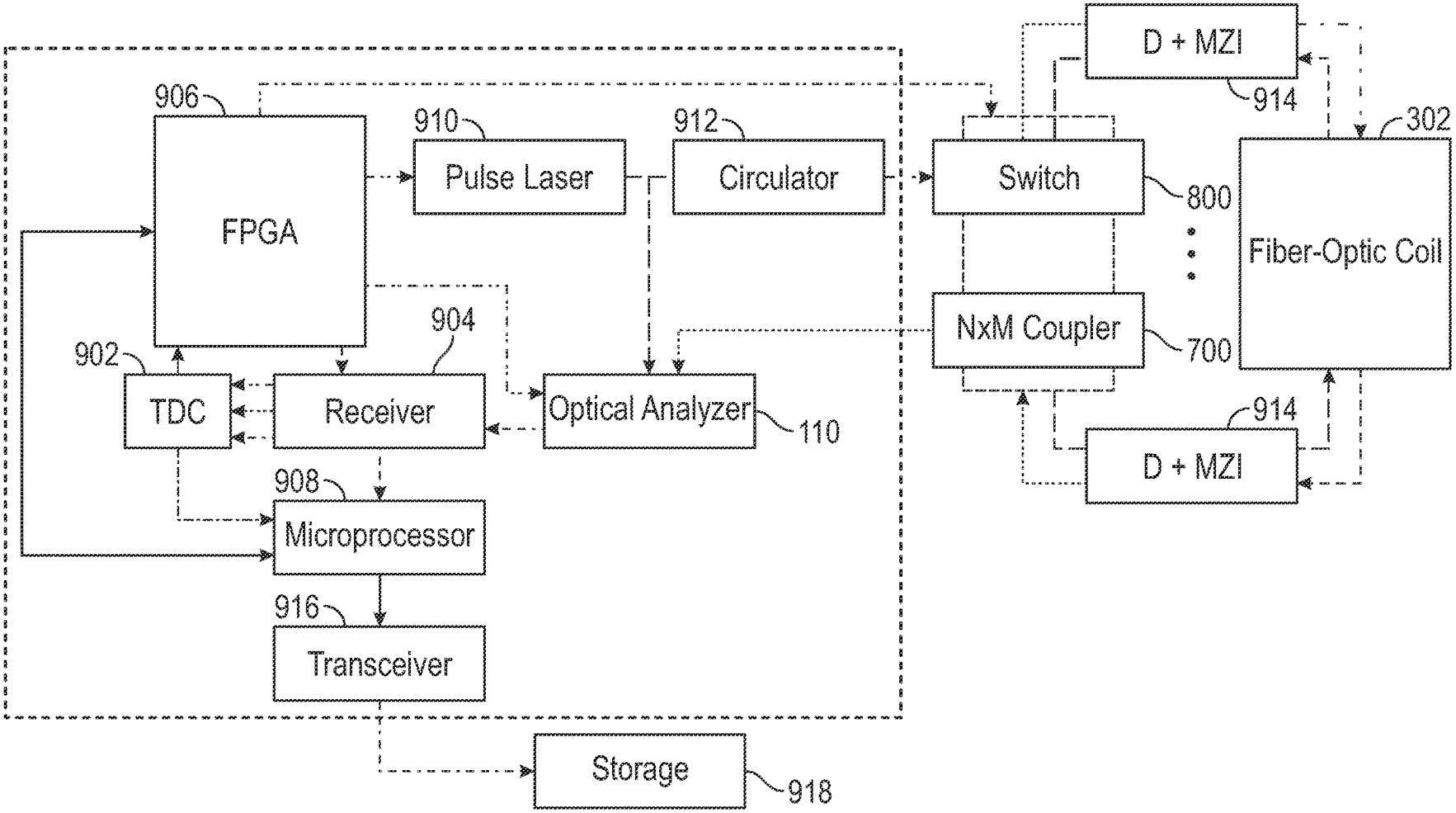
FIG. 10 shows a schematic of electronics and signal processing for N-shared source and M-distributed fiber probes.
Figure 11:
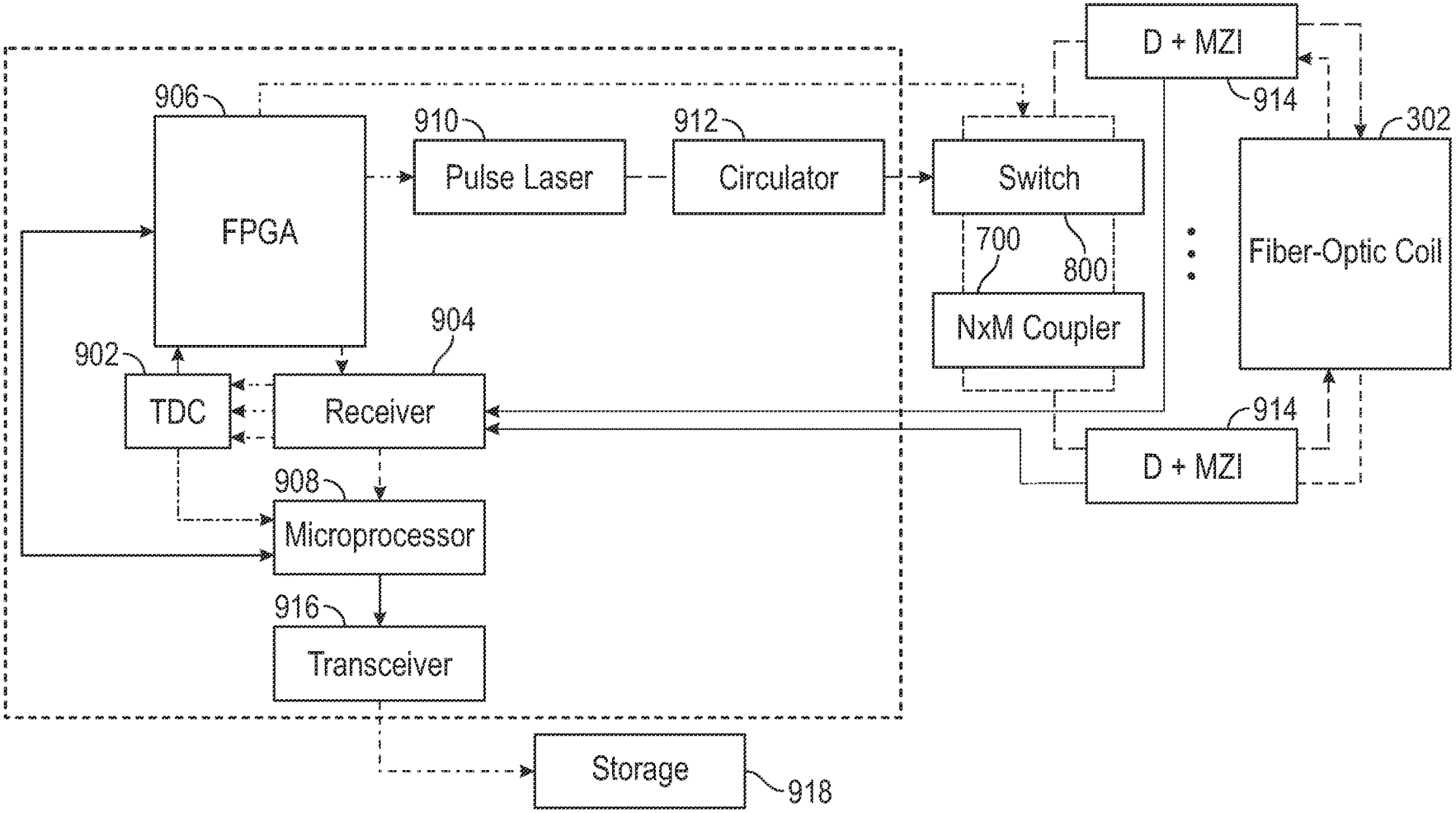
FIG. 11 shows a schematic of electronics and signal processing for N-shared source and M-distributed fiber probes.

FIGS. 9-11 show flow diagrams of possible electronic and signal processing units for N-sources of lasers and M-probes. The M-probes may be the fiber-optic coils (302). Thus, the invention employs, in one or more embodiments, N lasers to M fibers using switches at each of the N lasers to direct light to each of the MN fibers connected to the N-th laser. Those skilled in the art will appreciate that the measurement/interrogation system could be set up in multiple ways, depending on the the number of sources, fibers, and analyzers. FIGS. 9-11 depict three electronic and data acquisition frameworks that may be used to process the measurement data from the fiber optic sensors/coil.

In FIGS. 9-11, the region enclosed by the dashed box sits at surface and can be replicated N-times to provide parallel analysis. The electronics in the configuration control the light source, triggers, time digital converter (TDC) (902), and receiver (904). The receiver (904) has a Digital/Analog converter (D/A), which encodes the signal frequency and amplitude for processing. One skilled in the art would appreciate the electronics use a Field Programmable Gate Arrays (FPGA) (906) as a trigger or start. The microprocessor (908) can perform the required calculation to estimate the frequency difference and absorption profile of the FPGA (906). The FPGA (906) may trigger a pulse laser (910), such as a femtosecond pulse laser (FC), to send laser pulses. The laser pulses may be sent to the optic-fiber coil (302) through a circulator (912), delay+Mach-Zehnder Interferometer (D+MZI) (914), or the optical analyzer (110). The fiber-optic coil (302) may send the laser pulses through the switch (800) and/or the N×M coupler (700). The TDC (902) counts the time intervals between each signal and sends a reset trigger to the FPGA (906) upon occurrence of a max set interval. If using a single laser, in addition to each out-coupler an acousto-optic amplitude modulator could be used to distinguish between outputs. The TDC (902) or receiver (904) may communicate data to the microprocessor (908). The microprocessor (908) may send calculations through the transceiver (916) and store in storage (918) such as supervisory control and data acquisition (SCADA). In one or more embodiments, the optical analyzer is configured to launch the laser pulses. Alternatively, the pulse laser may directly pulse the fiber optic coils.

In FIG. 9, a single analyzer configuration is shown, which can utilize commercial optical analyzer (110) systems such as OTDR/OFDR systems.

In FIGS. 10 and 11, the optical detection state is prepared in the subsurface using the D+MZI (914). The resulting interference pattern can be transmitted to surface for analysis.

FIG. 10 shows a schematic of electronics and signal processing for a single analyzer configuration, which may utilize the optical analyzer (110) such as commercial OTDR/OFDR systems; N-source and M-fiber probes. This configuration can be used by the discrete and distributed system.

FIG. 11 shows a schematic of electronics and one signal processing for heterodyne detection in subsurface; N-shared source and M-distributed fiber probes. The optical signal is converted into two RF signals using a balanced heterodyne detection (BHD) configuration in the D+MZI (914). The RF signal is transmitted to surface for analysis.

In one or more embodiments, energy is provided to the system by directly harvesting it from the flow; for example, using Tesla microturbines. Another alternative is to harvest the energy from pressure gradients in the flow along the packer using thermoelectric materials specially designed for low-thermal gradients and high-pressure. The energy can also be provided via electric cables, through the optical communication fiber, or by downhole batteries. If energy is provided through an optical fiber link, then in addition to the transceiver 0, the system could include a 1×2 90/10 beam splitter and a photocell at the end of the 90%-transmission-arm. The photocell's bandgap could be designed to harvest the maximum power from the incoming signal.

Figure 12:
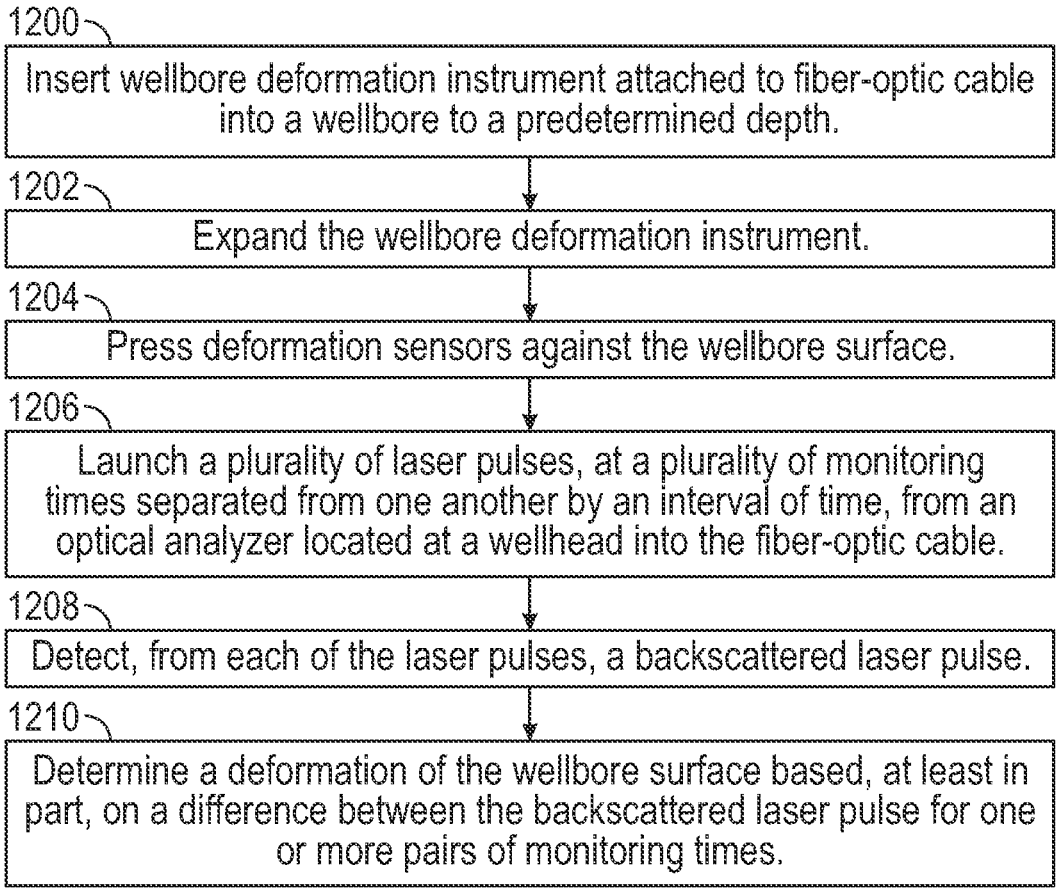
FIG. 12 shows a flowchart in accordance with one or more embodiments.

FIG. 12 shows a flowchart in accordance with one or more embodiments. Specifically, FIG. 12 shows a method and apparatus for the wellbore deformation instrument (300). One or more blocks in FIG. 12 may be performed using one or more components as described in FIGS. 1 through 11. While the various blocks in FIG. 12 are presented and described sequentially, one of ordinary skill in the art will appreciate that some or all of the blocks may be executed in parallel and/or iteratively. Furthermore, the blocks may be performed actively or passively.

In Block 1200, the wellbore deformation instrument (300) attached to a fiber-optic cable (112) is inserted into the wellbore to a predetermined depth. The wellbore deformation instrument (300) may be attached through an optical coupler (303) connecting fiber-optic coils (302) in the wellbore deformation instrument (300) to the fiber-optic cable (112). The wellbore may be the borehole (106). The wellbore deformation instrument (300) may be inserted by attaching a conveyance mechanism such as production tubing (116).

In Block 1202, the wellbore deformation instrument (300) is expanded in the wellbore. The expansion of the wellbore deformation instrument (300) presses a plurality of deformation sensors against the wellbore surface (Block 1204). The deformation sensors may be the deformable substrate (306) embedded with fiber-optic coils (302). In Block 1206, a plurality of laser pulses is launched, at a plurality of monitoring times separated from one another by an interval of time, from an optical analyzer (110) located at the wellhead (111) into the fiber-optic cable (112). The laser pulses may be sent to the optical analyzer (110) by a pulse laser (910) triggered by the FPGA (906). The optical analyzer (110) may be an optical time-domain reflectometer (OTDR) analyzer. In Block 1208, a backscattered laser pulse from each of the laser pulses is detected. The backscattered laser pulse may be detected, calculated, and processed by the receiver (904), microprocessor (908), TDC (902), and transceiver (916). In Block 1210, the deformation of the wellbore surface is determined based, at least in part, on a difference between the backscattered laser pulse for one or more pairs of monitoring times. Blocks 1206 through 1210 may be repeated as many times as necessary.

Although only a few example embodiments have been described in detail above, those skilled in the art will readily appreciate that many modifications are possible in the example embodiments without materially departing from this invention.

What is claimed:

1. A wellbore deformation instrument, comprising:
an expandable annular cylindrical packer;
a plurality of assemblies mounted on an exterior circumferential surface of the packer and configured to be pressed against a wellbore surface by the packer, wherein the each of the assemblies comprises:
at least one fiber-optic coil embedded in a sheet of deformable substrate,
a tray-shaped receptacle formed from a low thermal conductivity material and attached along a rim of the receptacle to an edge of the sheet with a pressure tight-seal, wherein a pressure-tight compartment formed by the receptacle, the sheet, and the seal contains a high-pressure inert gas, and
an optical coupler, configured to couple the at least one fiber-optic coil to a fiber-optic cable.

2. The wellbore deformation instrument of claim 1, wherein the plurality of assemblies comprises a laser and an optical switch.

3. The wellbore deformation instrument of claim 1, wherein the sheet of deformable substrate is made of a high-temperature elastomer, a flexible thermoplastic, or a shape memory polymer (SMP).

4. The wellbore deformation instrument of claim 1, wherein the plurality of assemblies is made of a non-metallic material.

5. The wellbore deformation instrument of claim 4, wherein the non-metallic material is a fiberglass composite.

6. The wellbore deformation instrument of claim 1, wherein the at least one fiber-optic coil comprises a plurality of non-overlapping fibers.

7. The wellbore deformation instrument of claim 1, wherein the at least one fiber-optic coil includes three or more fiber Bragg gratings (FBGs).

8. A system, comprising:
a wellbore deformation instrument, comprising:
an expandable annular cylindrical packer,
a plurality of assemblies mounted on an exterior circumferential surface of the packer and configured to be pressed against a wellbore surface by the packer, wherein the each of the assemblies comprises:
at least one fiber-optic coil embedded in a sheet of deformable substrate,
a tray-shaped receptacle formed from a low thermal conductivity material and attached along a rim of the receptacle to an edge of the sheet with a pressure tight-seal, wherein a pressure-tight compartment formed by the receptacle, the sheet, and the seal contains a high-pressure inert gas, and
an optical coupler, configured to couple the at least one fiber-optic coil to a fiber-optic cable;
a fiber-optic cable deployed in a wellbore running from a wellhead into a subsurface formation and optically coupled, through the optical coupler, to each of the at least one fiber-optic coil; and
an optical analyzer, configured to launch a laser pulse into the fiber-optic cable at the wellhead and receive a backscattered laser pulse from each of the at least one fiber-optic coil through the fiber-optic cable.

9. The system of claim 8, wherein the plurality of assemblies comprises a laser and an optical switch.

10. The system of claim 8, wherein the sheet of deformable substrate is made of a high-temperature elastomer, a flexible thermoplastic, or a shape memory polymer (SMP).

11. The system of claim 8, wherein plurality of assemblies is made of a non-metallic material.

12. The system of claim 11, wherein the non-metallic material is a fiberglass composite.

13. The system of claim 8, wherein the optical analyzer is an optical time-domain reflectometer (OTDR) analyzer.

14. The system of claim 8, wherein the at least one fiber-optic coil comprises a plurality of non-overlapping fibers.

15. The system of claim 8, wherein the at least one fiber coil includes three or more fiber Bragg gratings (FBGs).

* * * * *